US007226518B2

(12) United States Patent
Loubinoux

(10) Patent No.: US 7,226,518 B2
(45) Date of Patent: Jun. 5, 2007

(54) METHOD AND DEVICE FOR MAKING A COMPOSITE SHEET WITH MULTIAXIAL FIBROUS REINFORCEMENT

(75) Inventor: Dominique Loubinoux, La Motte Servolex (FR)

(73) Assignee: Saint-Gobain Vetrotex France S.A., Chambery (FR)

( * ) Notice: Subject to any disclaimer, the term of this patent is extended or adjusted under 35 U.S.C. 154(b) by 25 days.

(21) Appl. No.: 10/468,399

(22) PCT Filed: Feb. 20, 2002

(86) PCT No.: PCT/FR02/00636

§ 371 (c)(1),
(2), (4) Date: Aug. 29, 2003

(87) PCT Pub. No.: WO02/070806

PCT Pub. Date: Sep. 12, 2002

(65) Prior Publication Data

US 2004/0082244 A1 Apr. 29, 2004

(30) Foreign Application Priority Data

Mar. 1, 2001 (FR) ..... 01 02837

(51) Int. Cl.
*B32B 37/00* (2006.01)

(52) U.S. Cl. ..... 156/148; 156/166; 156/181; 19/296; 19/299; 19/163

(58) Field of Classification Search ..... 156/148, 156/166, 440, 439, 181; 19/145, 145.5, 296, 19/299, 163
See application file for complete search history.

(56) References Cited

U.S. PATENT DOCUMENTS 2,671,496 A * 3/1954 Chavannes et al. ..... 264/116
3,875,616 A * 4/1975 Trott ..... 19/163
3,903,568 A * 9/1975 Watson ..... 19/163
3,903,569 A * 9/1975 Brandis ..... 19/163
3,994,762 A 11/1976 Wrzesien et al.
4,107,822 A * 8/1978 Brown ..... 19/163
4,677,831 A * 7/1987 Wunner ..... 156/439
4,925,729 A * 5/1990 O'Connor ..... 156/148
5,047,109 A * 9/1991 Krueger ..... 156/439

(Continued)

FOREIGN PATENT DOCUMENTS

DE 3501897 A1 * 7/1986
FR 2 761 380 10/1998
FR 2 792 952 11/2000

(Continued)

*Primary Examiner*—Jeff H. Aftergut
(74) *Attorney, Agent, or Firm*—Oblon, Spivak, McClelland, Maier & Neustadt, P.C.

(57) ABSTRACT

The invention relates to the manufacture of composite sheets having a multiaxial fibrous reinforcement, which involves:

Figure 1:
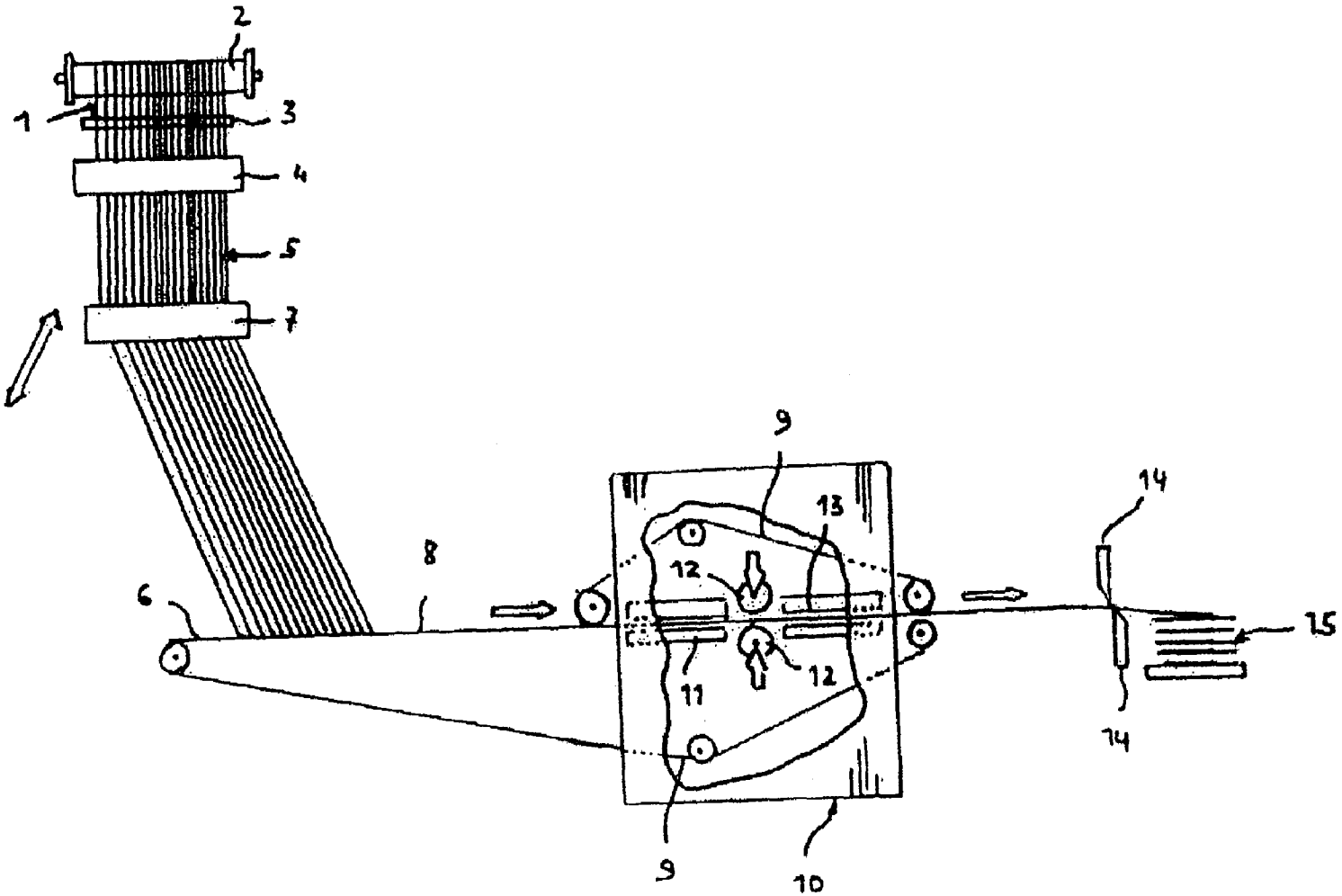

forming a unidirectional lap of reinforcing threads, at least 50% by weight of which are co-blended threads consisting of reinforcing filaments and of filaments of an organic material which are intimately mixed, giving the said lap a cohesion allowing it to be lapped, lapping this lap on a support in movement, in a transverse direction in relation to the direction of movement, heating the reinforcing-thread/organic-material assembly, which is displaced in the direction of movement, and setting it by the action of heat, if appropriate by applying pressure, then cooling it to form a composite band, and collecting the said band in the form of one or more composite sheets.

The present invention also relates to an apparatus for carrying out the method and to the products obtained.

26 Claims, 3 Drawing Sheets

U.S. PATENT DOCUMENTS

| | | | | |
|---|---|---|---|---|
| 5,289,617 | A | 3/1994 | Jean et al. | |
| 5,445,693 | A * | 8/1995 | Vane | 156/148 |
| 5,662,761 | A | 9/1997 | Middelman et al. | |
| 5,891,284 | A * | 4/1999 | Woodside et al. | 156/148 |
| 6,294,036 | B1 | 9/2001 | Loubinoux et al. | |
| 6,585,842 | B1 * | 7/2003 | Bompard et al. | 156/166 |
| 2002/0124936 | A1 | 9/2002 | Loubinoux | |

FOREIGN PATENT DOCUMENTS

| | | | |
|---|---|---|---|
| FR | 2 797 892 | | 3/2001 |
| WO | WO-93/24692 | A1 * | 12/1993 |
| WO | 97 26397 | | 7/1997 |
| WO | 98 31857 | | 7/1998 |
| WO | WO-98/44183 | A1 * | 10/1998 |
| WO | 99 44810 | | 9/1999 |
| WO | 00 48821 | | 8/2000 |
| WO | 01 34892 | | 5/2001 |

* cited by examiner

METHOD AND DEVICE FOR MAKING A COMPOSITE SHEET WITH MULTIAXIAL FIBROUS REINFORCEMENT

The invention relates to the production of composite sheets having a multiaxial fibrous reinforcement and, more particularly, of composite sheets formed by the combination of unidirectional laps of reinforcing fibres, such as glass fibres, arranged in different directions, and of an organic material.

One field of use of the invention is the production of composite sheets having a multiaxial fibrous reinforcement which are intended for the manufacture of components moulded from composite materials, in particular of components requiring considerable deformations during moulding.

Composite sheets are conventionally composed of at least two materials having different melting points which are generally a thermoplastic organic material serving as a matrix and a reinforcing material embedded within the said matrix. During manufacture, the thermoplastic organic material may assume the appearance of a liquid or of a solid, such as a powder, a film, a leaf or threads. The reinforcing material, in turn, may take the form of continuous or cut threads, a mat of continuous or cut threads, fabric, netting, etc. The choice of the shape and type of each material to be combined depends on the final configuration and properties of the component to be produced.

There are already numerous methods making it possible to combine a reinforcing material and a thermoplastic organic material.

In FR-A-2 500 360, composite sheets are manufactured by the hot-pressing of superposed layers of fabrics of reinforcing threads and of thermoplastic threads, the latter being capable of being arranged in warp, in weft or in both at the same time. However, the use of the composite sheets obtained remains limited to the production of flat panels or of curved components with a simple configuration with little deformation.

In French patent application no. 9910842, composite sheets are obtained by combining a bundle of parallel threads and a lap of threads oriented transversely in relation to the direction of the bundle, then by subjecting the assembly thus formed to heating followed by cooling. The threads of the assembly are mostly co-blended threads consisting of glass filaments and of filaments of thermoplastic material which are intimately mixed. The composite sheets obtained consist of orthogonal (90°) crossed laps.

In FR-A-2 743 822, it was proposed to manufacture a composite sheet by depositing continuously onto a conveyor a fabric of co-blended threads of glass filaments and of thermal plastic filaments, if appropriate combined with continuous or cut threads. The assembly is subsequently preheated in a hot-air furnace and then introduced into a "band press", within which it is heated and cooled, at the same time being kept compressed. Although being particularly suitable for the production of components of complex shape by moulding or by stamping, the composite sheet is not entirely satisfactory when components are to be obtained which have, furthermore, a great amount of deformation.

U.S. Pat. No. 4,277,531 also described a composite sheet capable of producing components of complex configuration by moulding. According to this patent, two bands of needled mats of continuous glass threads are delivered along parallel paths to a hot-pressing apparatus where they are joined together. Those faces of the bands which are opposite one another when the latter are joined together are coated with a liquid thermoplastic material and the outer faces are covered with a film of thermoplastic organic material. This assembly is simultaneously heated and compressed in order to ensure the fusion of the films and is cooled. The manufacture of such a composite sheet is relatively complex, and, moreover, it does not allow the reinforcing threads to be arranged in a plurality of directions.

One object of the present invention is to provide a method for the production of composite sheets formed by the combination of a thermoplastic organic material and of unidirectional laps of reinforcing threads, particularly of glass, arranged in different directions, for the purpose, in particular, of making it possible to produce composite components of complex shape (for example, capable of comprising ribs connected or not to parts having a small radius of curvature, etc.) and with a high relief requiring considerable deformations (that is to say deformations of great extent) of the fibrous structure.

Another object of the invention is to provide homogeneous composite sheets having a multiaxial fibrous reinforcement, possessing a regular orientation of the fibres and capable of having a high mass per unit area (of the order of 500 g/m$^2$ and up to 1000 to 1500 g/m$^2$, even 3000 g/m$^2$) and the width of which may reach 3 metres. Particularly in question are composite sheets having a multiaxial fibrous reinforcement, possessing a symmetry character and with a main unidirectional lap (0°) located on one side and/or the other of transverse unidirectional laps forming opposite angles ($-\alpha/+\alpha$) in relation to the main direction.

Another object of the invention is to provide a method and an apparatus for carrying out this method, making it possible to produce continuously and in a single step composite sheets having a multiaxial fibrous reinforcement, with a variable and relatively high mass per unit area, from relatively wide unidirectional laps, without the need to make use of connecting threads.

Another object of the invention is to provide a unidirectional lap comprising co-blended threads consisting of reinforcing filaments and of thermoplastic filaments, which have sufficient cohesion to be capable of being handled, that is to say without the threads of which it is composed being capable of dispersing, but which nevertheless possesses flexibility compatible with the lapping operation.

The objects are achieved by means of the method of the invention which comprises the steps involving:

forming a unidirectional lap of reinforcing threads, at least 50% by weight of which are co-blended threads consisting of reinforcing filaments and of filaments of an organic material which are intimately mixed, giving the said lap a cohesion allowing it to be lapped, lapping this lap on a moving support in movement, in a transverse direction in relation to the direction of the movement, heating the reinforcing-thread/organic-material assembly, which is displaced in the direction of movement, and setting it by the action of heat, if appropriate by applying pressure, then cooling it to form a composite band, and collecting the said band in the form of one or more composite sheets.

The various steps of the method, such as the driving of the unidirectional lap, the lapping of the lap, etc., advantageously take place continuously.

By "sheet" (likewise by "band") is meant, according to the present invention, an element of small thickness in relation to its area, generally plane (but, if appropriate, capable of being curved) and rigid, whilst at the same time maintaining the capacity, as the case may be, of being capable of being collected and preserved in wound form, preferably on a support having an outside diameter greater than 150 mm. In general terms, a solid or a substantially solid element is concerned, that is to say one which has a ratio of open area to total area which does not exceed 50%.

By "composite" is meant, according to the present invention, the combination of at least two materials with different melting points, generally at least one thermoplastic organic material and at least one reinforcing material, the material content which has the lowest melting point (organic material) being at least equal to 10% by weight of the said combination and preferably at least equal to 20%.

As regards the terms "lapped", "lapping", etc. in relation to a lap, this is intended to embrace whatever relates to the fact that a lap is deposited onto a surface in an alternating movement with a given amplitude, the lap being overturned at each change in direction. The lapping of the lap is generally obtained with the aid of a spreader/lapper, as described, for example, in EP-A-0 517 563.

According to the present invention, "sufficient cohesion" of the unidirectional lap is intended to mean that the elements forming the said lap are connected to one another in such a way that they allow the lap to undergo the lapping operation, without any appreciable damage to its structure. The cohesion is sufficient when the threads are not or are only slightly dissociated from one another or when no defects, in particular tears, appear at the time of lapping. Within the context of the invention, the cohesion is sufficient when the lap has a tensile strength in the transverse direction greater than 5 N/5 cm, measured under the conditions of the standard NF EN 29073-3.

By "support in movement" is meant a conveyor which transfers the reinforcing-thread/organic material combination from one point on a production line to another. A unidirectional lap of reinforcing threads and of threads of organic material which are separate from one another is also meant.

The method according to the invention makes it possible to obtain composite sheets having a multiaxial fibrous reinforcement in a single operation from simple initial structures. To be precise, the method according to the invention makes use essentially of unidirectional structures: in particular, the reinforcing material used in the method according to the invention is provided solely in the form of threads made cohesive by means of mechanical treatment leading to a slight intermingling of the filaments of which they are composed, by means of moderate thermal treatment or else by means of suitable chemical treatment, and not incorporated into "complex" structures, such as fabrics, assemblies of threads held by connecting threads, etc. The use of these simple reinforcing structures in the manufacture of sheets according to the invention has advantages particularly in terms of cost and of ease of implementation. From the simple structures which are the threads, the method according to the invention makes it possible to form directly a unidirectional lap having sufficient cohesion, but also flexibility, to be capable of being lapped, that is to say to form transverse laps arranged symmetrically with respect to the driving direction. Within the context of the present invention, the flexible character is assessed in the following way: with a lap held horizontally at one end and resting on the generatrix of a cylinder with a diameter of 10 cm, the angle which the free end of the lap forms with the horizontal is measured over a length of 25 cm. Flexibility is sufficient when the value of the angle is equal to or greater than 70°.

In particular, the method proves advantageous in that it is possible to vary the lapping angle to a very great extent, for example from 30 to 85°, preferably 40 to 70°, and particularly preferably equal to 45 or 60°, and also in that the value of the angle can easily be modified simply by adjusting the speed of the conveyor and, if appropriate, by varying the width of the transversely deposited lap if it is desirable that the mass per unit area of the reinforcing-thread/organic-material assembly should remain constant. Finally, the method according to the invention is particularly rapid and economical, particularly because it makes it possible to obtain the sought-after sheets directly from threads continuously, by the omission of the transfers from one installation to another and the storage of intermediate structures (laps, fabrics, nettings).

According to the invention, at least 50% of the threads involved in the formation of the unidirectional lap consist of co-blended threads consisting of reinforcing filaments and of filaments of an organic material which are intimately mixed (for example, as described in EP-A-0 599 695 and EP-A-0 616 055). Preferably, the lap comprises at least 80% by weight, particularly preferably 100% by weight, of co-blended threads.

The reinforcing material is generally selected from the materials commonly used for the reinforcement of organic materials, such as glass, carbon, aramid, ceramics and plant fibres, for example flax, sisal or hemp, or capable of being understood in the broad sense as a material with a melting or decomposition point higher than that of the abovementioned organic material. Glass is preferably selected.

The organic material is, for example, polyethylene, polypropylene, polyethyleneterephthalate, polybutyleneterephthalate, phenylenepolysulphide, a polymer selected from thermoplastic polyamides and polyesters or any other organic material with a thermoplastic character.

Preferably, the threads of the unidirectional lap are selected such that the content of organic material in the composite sheet is at least equal to 10% by weight and such that the content of reinforcing material is between 20 and 90% by weight, preferably between 30 and 85%, and particularly preferably between 40 and 80%.

The unidirectional lap may comprise partially threads consisting of one of the materials and partially threads consisting of the other material, these threads then being arranged alternately in the lap.

In the method according to the invention, the threads of the unidirectional lap usually originate from one or more supports (for example, bobbins supported by one or more creels) or packages (for example, beams) on which they are wound.

The step involving giving the unidirectional lap a sufficient cohesion for it to be capable of being lapped must contribute to maintaining the intactness of the reinforcing filaments, so that these perform the reinforcing function assigned to them. This step may be carried out in several ways.

According to a first variant, the cohesion of the lap can be imparted by means of a slight entanglement of the filaments forming the threads by means of moderate needling or by exposure to a jet of water under pressure. When needling is concerned, any suitable apparatus may be used, for example a support equipped with needles which is driven in a vertical alternating movement and which penetrates through the entire thickness of the lap, at the same time causing a transverse intermingling of the filaments. Entanglement by exposure to a jet of water under pressure can be carried out by water being projected onto the lap arranged on a perforated support or passing over a metal belt, and the water jets rebounding on the belt bringing about a moderate intermingling of the threads.

According to a second variant, the filaments are made cohesive by means of moderate thermal treatment at a temperature near the melting temperature of the organic material. It is important that the melting of the threads takes place on the surface, that is to say over a small thickness, so that the lap preserves a flexibility compatible with subsequent lapping. In general, the operation is carried out at a temperature a few ° C. and up to 15° C. higher than the melting temperature of fusion of the said organic material. This variant is particularly suitable when the threads are close to one another, for example at a distance of less than 0.2 mm from one another, fusion then making it possible to connect the threads by contact.

Thermal treatment may be carried out by any suitable heating means, for example heated cylinders, an irradiation apparatus, such as an infrared-radiation apparatus (furnace, lamp or lamps, panel or panels) and/or one or more hot-air blowing devices (hot-air furnace with forced convection).

According to a third variant, the cohesion of the lap may be obtained by the supply of a chemical material having adhesive properties with respect to the threads. This material may be liquid or solid, for example a powder, a film or a web of a material. The materials which generate their hot-bonding (or heat-sealing) properties are preferred. Advantageously, the heat-sealing material is compatible with the organic materials of the threads, and generally the two materials are identical. Polyolefins and, more particularly, polypropylene are preferred.

Preferably, the heat-sealing material is deposited in the form of a web or of a film, the latter advantageously comprising at least one additional layer of organic material of the same type as that of the threads, preferably likewise in the form of fibres or of filaments.

The bonding material may be deposited by projection or spraying, when it is in liquid or powder form, and by the application of the film or web, followed by heating, preferably together with compression, for example between the rolls of a calender.

This variant makes it possible to connect threads which are relatively far from one another, up to a distance of approximately 1 cm.

The combination of the unidirectional laps within the composite sheet having a multiaxial fibrous reinforcement may take place in several ways.

According to a first embodiment, the unidirectional lap is lapped transversely on a conveyor. A lap having a biaxial fibrous reinforcement is formed, which consists of unidirectional transverse laps, the directions of which form angles $-\alpha$ and $+\alpha$ with the direction of movement (0°).

According to a second embodiment, the unidirectional lap is lapped transversely on a main unidirectional lap, itself deposited onto a conveyor, and composed of reinforcing threads and of threads of organic material. A lap having a triaxial fibrous reinforcement is thereby formed, consisting of unidirectional transverse laps, the directions of which form angles $-\alpha$ and $+\alpha$ with the direction of the main unidirectional lap (0°).

The reinforcing-thread/organic-material combination (displaced at a speed of, for example, between 0.5 and 10 m/min) passes under at least one zone, where it is heated to a temperature between the melting or decomposition points of the materials forming the combination, this temperature likewise being below the decomposition temperature of the material having the lowest melting point. By extension, here, the decomposition temperature designates the minimum temperature at which is observed a decomposition of the molecules forming the material (as conventionally defined and understood by a person skilled in the art) or an undesirable change in the material (for example, inflammation, loss of intactness resulting in a flow of the material out of the lap) or undesirable colouring (for example, yellowing).

In the present invention, the reinforcing-thread/organic-material combination is heated sufficiently to make it possible to connect at least some of the threads to one another by means of the organic material after heating and/or compression, and, in most cases, to make it possible to obtain a substantially solid structure.

By way of example, the heating temperature may be of the order of 190 to 230° C. when the thread lap consists of glass and of polypropylene, of the order of 280 to 310° C. when the lap consists of glass and of polyethylene terephthalate, and of the order of 270 to 280-290° C. when the thread lap consists of glass and of polybutylene terephthalate.

The heating of the reinforcing-thread/organic-material combination may be carried out in various ways, for example with the aid of a double-band laminating machine or with the aid of heated cylinders or of an irradiation device, such as an infrared radiation device (for example, by means of a furnace, a lamp or lamps, a panel or panels) and/or at least one hot-air blowing device (for example, a hot-air furnace with forced convection).

Heating may be sufficient to allow the setting of the reinforcing-thread/organic-material combination by means of the melted organic material (thermosetting). In many cases, however, the heated combination also undergoes compression which may be carried out by means of one or more two-roll calenders, the force exerted on the combination generally being several daN/cm or even several tens of daN/cm. The pressure exerted in the compression device compacts the thread lap and makes it possible to obtain a homogeneous distribution of the melted thermoplastic material, the structure obtained being set by cooling, and it being possible for cooling to take place, at least partially, simultaneously with compression or likewise to take place after a hot-compression step.

The compression device may comprise or consist of a band press, for example equipped with bands made of steel, of glass cloth or of aramid coated with PTFE, which comprises a hot zone followed by a cold zone.

Cooling may take place in the compression device, for example in a cold calender, or may take place outside the compression device, for example by natural or forced convection.

At the exit of the compression device, it is possible to accelerate the cooling of the composite band by passing it over a cooling table in which, for example, cold water circulates. Additional means (press rollers, plates, nozzles cooled or not) may be added to the table, making it possible to improve cooling even further. At the exit of the table, it is also possible to place take-up rollers which make it possible to draw off the composite band.

The composite band, after compression and cooling, may be wound onto a mandrel having a diameter suitable for the characteristics of the band or may be cut into sheets, for example with the aid of a guillotine or a circular saw.

The present method, although described with regard to the lapping of a single unidirectional lap, may, of course, be used for the lapping of a plurality of laps in the same way as described above. It is also possible to interpose between the laps at least one unidirectional lap comprising reinforcing threads combined or not with organic material, in warp, in order to form sheets of greater thickness. The thickness limit depends essentially on the capacity of the device for heating the reinforcing-thread/organic-material assembly for compacting the lap in order to obtain a sheet according to the invention.

The present invention also relates to an apparatus for carrying out the method.

This apparatus comprises a conveyor, at least one thread feed device, means making it possible to make cohesive a thread lap comprising co-blended threads, at least one device making it possible to lap a thread lap transversely on the said conveyor, at least one device for heating the reinforcing-thread/organic-material assembly and at least one device for cooling the said assembly.

The apparatus according to the invention may comprise, furthermore, at least one device for compressing the said assembly and/or at least one cutting device and/or at least one device for collecting the composite sheets. The cooling device may be a compression device separate from the cooling device or consist of a single device performing both the compression and the cooling functions.

The composite sheets obtained by the combination of steps of the method according to the invention are, by virtue of their multiaxial structure, perfectly suited to the production of components made of composite materials by means of the moulding and thermoforming methods. In particular, the sheets according to the invention are notable in that the various laps are not connected to one another and the threads are therefore free to be displaced in relation to one another. It is thereby possible to obtain components which have considerable deformations and/or reliefs in the transverse direction in relation to the direction of movement (0°), when the reinforced sheets are of the triaxial type (0°/−α/+α or 0°/−α/+α/0° stacking), and also in other directions, when the sheets are of the biaxial type (−α/+α). The composite sheets obtained have a thickness generally of between a few tenths of mm and approximately 2 mm, are rigid and easy to cut and have good mechanical properties. Moreover, they possess a good surface state attributable, in particular, to the absence of interlacing of the threads which results in low shrinkage. It is possible to improve the appearance of the sheet by depositing one or even a plurality of films of a material performing the required function onto at least one of the outer faces of the reinforcing-thread/organic-material assembly before the final heating step aimed at forming the sheet.

Figure 2:
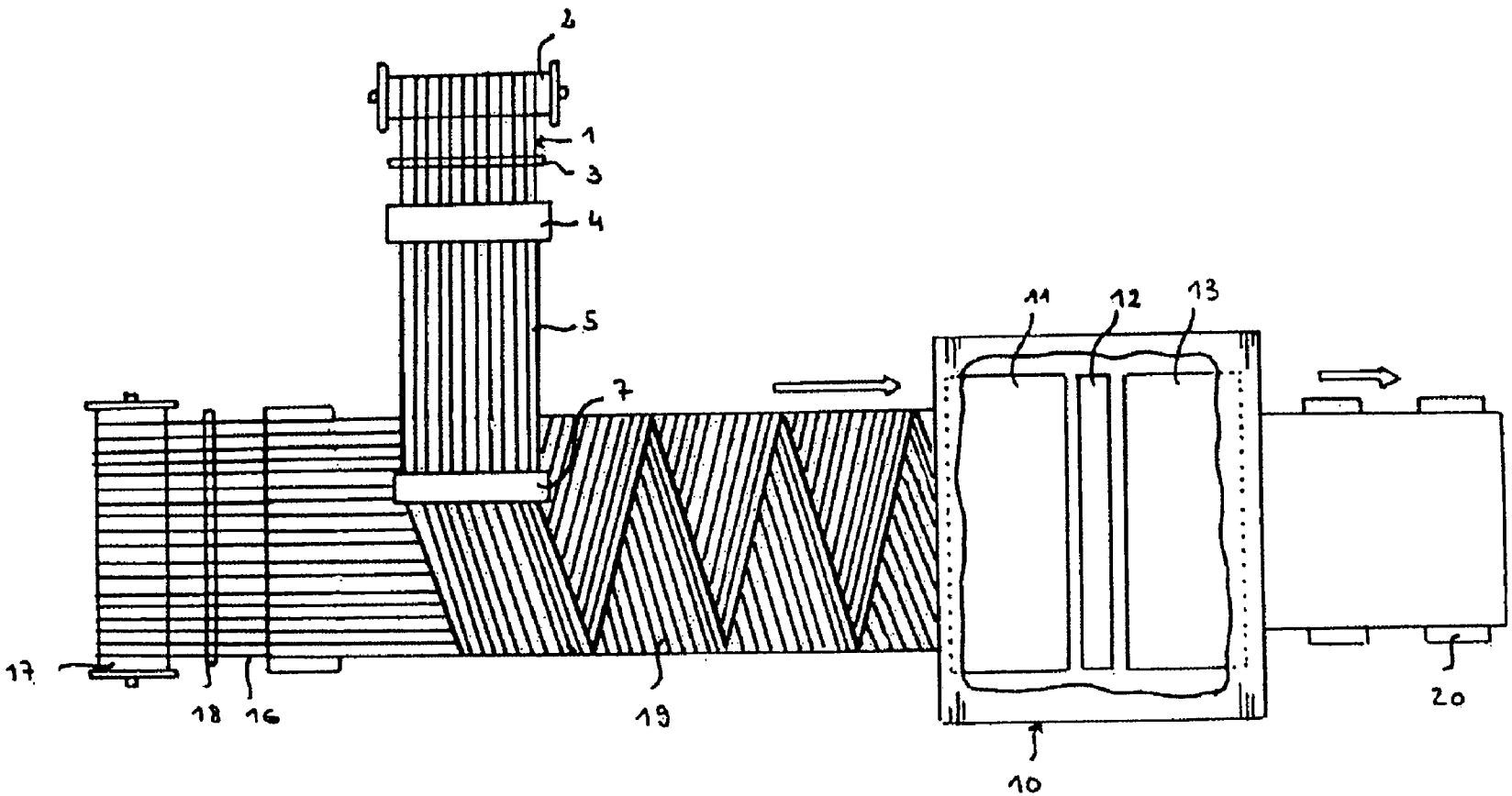
Figure 3:
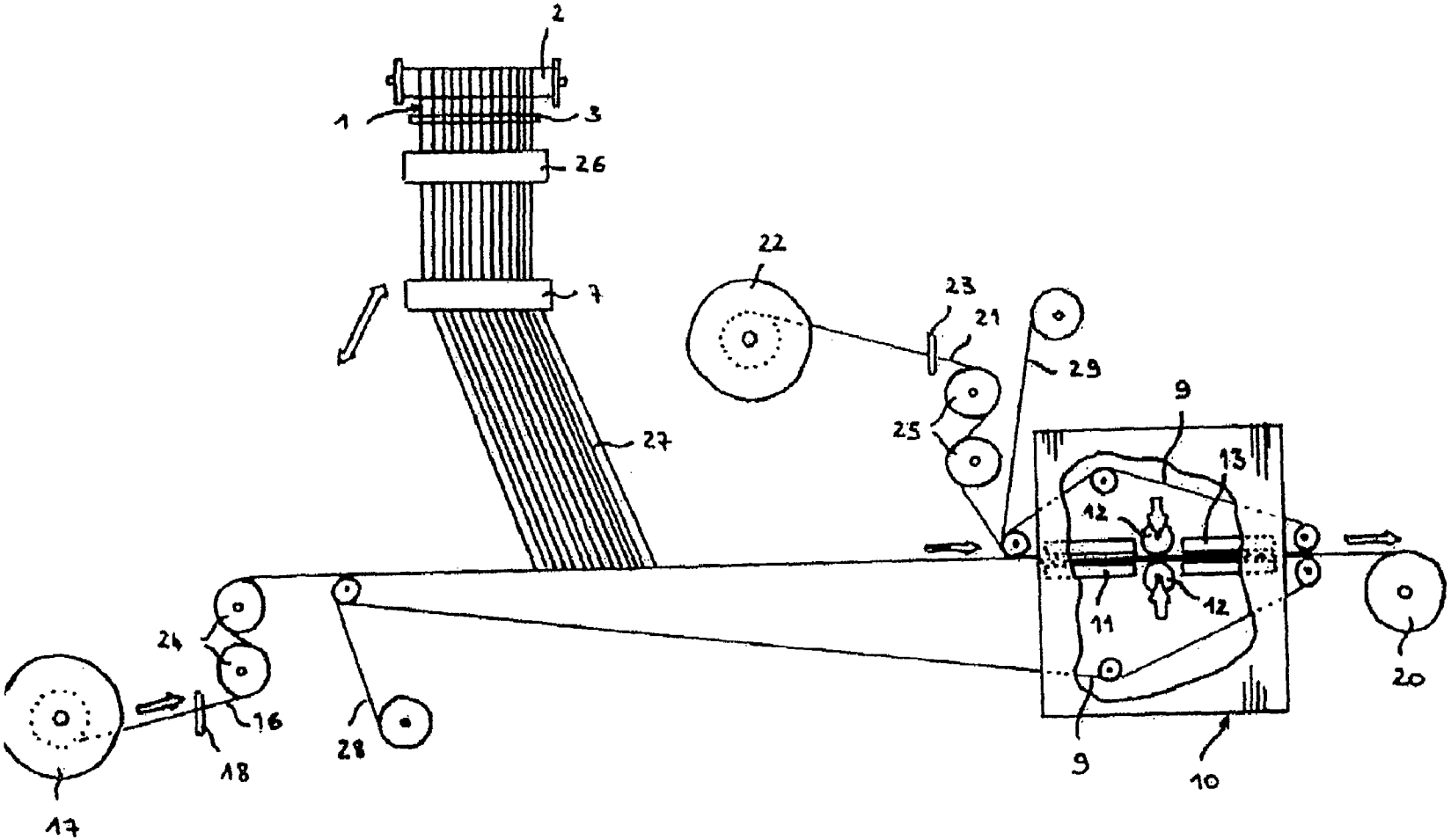

Other advantages and characteristics of the invention may be gathered from the drawings which illustrate the invention and in which:

FIG. 1 shows a diagrammatic view of an apparatus allowing a first implementation of the invention, FIG. 2 shows a diagrammatic top view of an apparatus allowing a second implementation of the invention, FIG. 3 shows a diagrammatic view of an apparatus allowing a third implementation of the invention.

Common elements bear the same references in the figures.

FIG. 1 describes a method for the manufacture of a composite sheet having a biaxial (−α/−α) fibrous reinforcement, in its simpler embodiment. The threads 1 coming from a beam 2 pass between the teeth of a comb 3 which keep them parallel up to their entry into a needling device 4 where they are connected to one another so as to form a unidirectional lap 5. The lap 5 is deposited onto a conveyor 6 in movement by means of a lapping device (spreader-lapper) 7 which is displaced transversely to the direction of displacement of the conveyor in an alternating movement, in order to form a lap having a biaxial fibrous reinforcement 8, the directions of which form opposite angles with the direction of displacement.

The biaxial lap 8 subsequently passes between the continuous bands 9 (made of glass fabric impregnated with polytetrafluoroethylene—PTFE—) of a flat laminating press 10. This press comprises a heating zone 11, press cylinders 12 which compress the melted thermoplastic material (a pressure of the order of 10–20 N/cm$^2$) and a zone 13 cooled by water circulation.

The composite band having a biaxial fibrous reinforcement, obtained at the exit of the press 10, is subsequently cut into a plurality of sheets 15 continuously by means of the blades 14 and of automatic shears (not illustrated).

The method of FIG. 2 describes a method for the manufacture of a sheet having a triaxial fibrous reinforcement, which makes use of a lap having a biaxial (−α/−α) fibrous reinforcement and a unidirectional lap arranged in warp (0°).

As in the embodiment of FIG. 1, a lap 5 is formed from threads 1 of the beam 2 which are guided towards the needling device 4 by the comb 3. The lap 5 is deposited by means of the lapping device 7 onto a unidirectional lap 16 supported by the conveyor 6, the lap 16 consisting, here, of the threads unwound from the beam 17 and kept parallel with the aid of the comb 18.

The combination of the laps 19 passes, as in the method of FIG. 1, into the press 10, where it is heated in the zone 11, compressed between the rollers 12 and cooled in the zone 13. The composite band obtained is subsequently wound onto the rotating support 20.

FIG. 3 describes diagrammatically a method for the manufacture of a composite sheet having a triaxial fibrous reinforcement, in which the lapped threads (−α/−α) are held between two unidirectional laps arranged in warp (0°).

This method makes use of two unidirectional laps 16 and 21 obtained from the beams 17 and 22, these threads passing into combs 18 and 23 keeping them parallel and then into take-up cylinders 24 and 25 which make it possible to reduce the tensions of the threads before their entry into the laminating press 10.

As in the preceding methods, the lap intended to be lapped is formed from the threads 1 coming from a beam 2, these threads passing onto a comb 3 in order to keep them parallel. The threads are subsequently introduced into a heated device 26 which sets them in the form of a lap 27 which is lapped between the laps 16 and 21 with the aid of the device 7.

The combination of these laps is subsequently directed towards the press 10 where, just as before, it is heated in the zone 11, compressed between the rollers 12, cooled in the zone 13 and finally wound onto the support 20.

The composite band obtained has a homogeneous appearance which may be improved by depositing a polymer film compatible with the organic material of the threads onto one or the other of its faces or onto both at the same time. In FIG. 3, two polypropylene films 28 and 29 are deposited on either side of the combination of the laps between the bands 9 of the press 10.

The following examples make it possible to illustrate the invention, but without limiting it.

EXAMPLE 1

A composite sheet is produced under the conditions of the method of FIG. 1, modified in that an additional unidirectional lap is deposited onto the lap having a biaxial glass reinforcement (as indicated in FIG. 3, lap 21).

A unidirectional lap with a width of 20 cm (2.2 threads/cm) is formed from 48 roving threads arranged on a creel. The threads are rovings having a linear density equal to 1870 tex and obtained by the co-blending of glass filaments (60% by weight; diameter: 18.5 μm) and of polypropylene filaments (40% by weight; diameter: 20 μm).

The lap is driven at a speed of 0.48 m/min in the needler 4 with a width of 1 m, equipped with 4000 needles (reference: 15×18×32 3.5RB30A 06/15) and set for a penetration of 20 mm and 200 strokes/min, that is to say 140 strokes/$cm^2$. At the exit of the needler, the lap has a width of 30 cm and a mass per unit area of 275 $g/m^2$.

The needled lap is subsequently deposited onto the conveyor driven by drive rollers, by means of the lapper 7, the lap being deposited alternately in opposite directions (+76° and −76° respectively) in relation to the depositing direction (0°), and each lap part deposited in one direction not covering the adjacent parts oriented in the same direction. Onto the biaxial lap thus formed is deposited, downstream of the lapper, in warp, the unidirectional lap 21 having a width of 60 cm and composed of co-blended threads of the same type as those forming the needled lap. The assembly formed subsequently passes into the press 10, within which it is heated (220° C.) and then cooled (60° C.), whilst at the same time being compressed (2 bar). The composite sheet has a mass per unit area equal to 825 $g/m^2$ and, in the direction 0°, has a bending stress at break equal to 180 MPa, a flexion modulus equal to 12 GPa and a shock absorption energy (Charpy) equal to 85 $kJ/m^2$.

EXAMPLE 2

A composite plate is produced, using a method according to FIG. 3, modified in that the heating device 26 is replaced by a needling device 4.

330 reels of rovings of the same type as those described in Example 1 are arranged on a first creel located in the prolongation of the conveyor, upstream of the latter. The rovings are distributed equally to two combs (0.75 teeth/cm), in order to form two identical unidirectional laps with a width of 2.15 m and a mass per unit area of 140 $g/m^2$. The first lap 16 is deposited directly onto the conveyor (speed: 1.5 m/min) and the second lap 21 is deposited downstream of the lapper.

370 rovings of the same type as those described in Example 1 are placed on a second creel. The rovings are arranged between the teeth of a comb (2.2 teeth/cm) in order to form a unidirectional lap (width: 1.68 m; mass per unit area: 410 $g/m^2$) which is directed towards the needler 4 (width: 3 m; speed: 2.5 m/min; 1000 strokes/min). The needled lap 5 (width: 2.5 m) is led towards the lapper 7 which deposits it alternately at the angles +60° and −60°, over a width of 2.15 m, onto the first unidirectional lap carried by the conveyor. Downstream of the lapper, the second unidirectional lap 21 originating from the first creel is deposited. The combination of the biaxial lap and of the two unidirectional laps is subsequently directed towards the press 10 in a first heated zone (220° C.; length: 2.2 m), a calender with a diameter of 300 mm (pressure: 2 bar) and a second cooling zone (10° C.; length: 2.3 m).

A composite sheet having a triaxial glass reinforcement (0°/−60°/+60°/0° stacking), with a thickness of approximately 0.6 mm and with a mass per unit area equal to 830 $g/m^2$, is obtained, which is either wound or cut into rectangular sheets by means of automatically controlled shears.

EXAMPLE 3

The procedure takes place under the conditions of Example 2, modified in that the first creel comprises 660 bobbins of rovings separated into identical laps (comb: 1.5 teeth/cm; mass per unit area: 280 $g/m^2$).

The composite sheet obtained has a thickness of approximately 0.75 mm and a mass per unit area equal to 1110 $g/m^2$.

EXAMPLE 4

A composite sheet is produced under the conditions of Example 2.

370 rovings of the same type as those described in Example 1 are placed on a creel. The rovings are arranged between the teeth of a comb (2.2 teeth/cm) in order to form a unidirectional lap (width: 1.68 m; mass per unit area: 410 $g/m^2$) which is directed towards the needler 4 (width: 3 m; speed: 2.5 m/min; 1000 strokes/min). The needled lap 5 (width: 2.5 m) is led towards the lapper 7 which deposits it alternately at the angles of +45° and −45°, over a width of 1.25 m, onto the conveyor (speed: 2.5 m/min).

The combination of the laps is directed towards the press 10 in a first heated zone (220° C.; length: 2.2 m), a calender with a diameter of 300 mm (pressure: 2 bar) and a second cooling zone (10° C.; length: 2.3 m).

The composite sheet formed has a mass per unit area equal to 650 $g/m^2$.

EXAMPLE 5

A composite sheet is produced, using the method described in FIG. 3.

On a first creel located in the prolongation of the conveyor are arranged, upstream of the lafter, 330 bobbins of rovings with a linear density equal to 1870 tex, which are obtained by the co-blending of glass filaments (57% by weight; diameter: 18.5 μm) and of polypropylene filaments (43% by weight; diameter: 20 μm).

The rovings are distributed to two combs (0.75 teeth/cm), so as to form two identical unidirectional laps 16 and 21 with a width of 2.15 m and a mass per unit area of 140 $g/m^2$. The first lap 16 is deposited directly onto the conveyor (speed: 1.5 m/min) and the second lap 21 is deposited downstream of the lapper.

370 bobbins of rovings of the same type as those of the first creel are placed on a second creel, and the rovings are distributed among the teeth of a comb (1.5 teeth/cm) in order to form a unidirectional lap (width: 2.5 m; mass per unit area: 280 $g/m^2$). This lap has combined with it a fibrous web comprising a polypropylene layer in the form of fibres (mass per unit area: 30 $g/m^2$) and a polyolefin-based heat-sealing layer in the form of fibres (mass per unit area: 30 $g/m^2$), the latter layer being directed towards the lap. The lap/web combination passes through the nip of a pair of press rollers heated to 140° C. and then towards the lapper 7 which deposits it at angles of +60° and −60°, over a width of 2.15 m, onto the first unidirectional lap carried by the conveyor. Onto this combination is deposited the second unidirectional lap 21 originating from the first creel, and the assembly is directed towards the press 10 consisting successively of a heated zone (220° C.; length: 2.2 m), of a calender with a diameter of 300 mm (pressure: 2 bar) and of a cooling zone (10° C.; length: 2.3 m).

A composite sheet with a thickness of approximately 0.6 mm and a mass per unit area equal to 900 $g/m^2$ is obtained.

The invention claimed is:

1. Method for manufacturing a composite sheet having a multiaxial fibrous reinforcement, comprising the steps which involve:

forming a unidirectional lap of reinforcing threads, at least 50% by weight of which are co-blended threads comprising reinforcing filaments and filaments of an organic material which are intimately mixed, giving said lap a cohesion allowing it to be lapped, depositing said lap on a support in movement in a transverse direction in relation to the direction of movement, wherein the depositing is made in an alternating movement with a given amplitude and the lap being overturned at each change in direction in the alternating movement, heating the reinforcing-thread/organic-material assembly, which is displaced in the direction of movement, and setting the assembly by the action of heat, if appropriate by applying pressure, then cooling the assembly in order to form a composite band, and collecting said band in the form of one or more composite sheets.

2. Method according to claim 1, wherein the support is a conveyor.

3. Method according to claim 1, wherein the sheet is a unidirectional lap of glass threads, at least some of which are co-blended threads comprising glass filaments and of filaments of a thermoplastic organic material.

4. Method according to claim 1, wherein the reinforcing filaments are glass filaments.

5. Method according to claim 1, wherein the unidirectional lap is composed solely of co-blended threads comprising glass filaments and of filaments of thermoplastic organic material.

6. Method according to claim 5, wherein the threads comprise at least 20% glass.

7. Method according to claim 1, wherein the lap is made cohesive by needling or by exposure to ajet of water under pressure.

8. Method according to claim 1, wherein the lap is made cohesive by moderate thermal treatment.

9. Method according to claim 1, wherein the lap is made cohesive by the supply of an adhesive material.

10. Method according to claim 9, wherein the material takes the form of a powder, a web or a film.

11. Method according to claim 1, wherein the lap is deposited onto the support by means of a spreader/lapper.

12. Method according to claim 1, wherein at least one unidirectional lap of co-blended threads comprising reinforcing filaments and of filaments of an organic material which are intimately mixed is deposited onto the transversely deposited lap, before the heating of the reinforcing-thread/organic-material assembly is carried out.

13. Method according to claim 12, wherein the reinforcing material is glass, and in that the organic material is thermoplastic.

14. A method for manufacturing a composite sheet having a multiaxial fibrous reinforcement, comprising:

forming a unidirectional lap of reinforcing threads, at least 50% by weight of which are co-blended threads comprising reinforcing filaments and filaments of an organic material intimately mixed, giving said lap a cohesion allowing it to be lapped, depositing said lap on a support in movement in transverse directions in relation to a direction of movement of the support, wherein the depositing is made in an alternating movement with a given amplitude and the lap being overturned at each change in direction in the alternating movement, said lap having a biaxial fibrous reinforcement forming opposite angles with the direction of movement, heating the reinforcing-thread/organic-material assembly, which is displaced in the direction of movement, and setting it by the action of heat, if appropriate by applying pressure, then cooling it in order to form a composite band, and collecting said band in the form of one or more composite sheets.

15. Method according to claim 14, wherein the support is a conveyor.

16. Method according to claim 14, wherein the support is a unidirectional lap of glass threads, at least some of which are co-blended threads comprising glass filaments and of filaments of a thermoplastic organic material.

17. Method according to claim 14, wherein the reinforcing filaments are glass filaments.

18. Method according to claim 14, wherein the unidirectional lap is composed solely of co-blended threads comprising glass filaments and of filaments of thermoplastic organic material.

19. Method according to claim 18, wherein the threads comprise at least 20% glass.

20. Method according to claim 14, wherein the lap is made cohesive by needling or by exposure to a jet of water under pressure.

21. Method according to claim 14, wherein the lap is made cohesive by moderate thermal treatment.

22. Method according to claim 14, wherein the lap is made cohesive by the supply of an adhesive material.

23. Method according to claim 22, wherein the material takes the form of a powder, a web or a film.

24. Method according to claim 14, wherein the lap is deposited onto the support by means of a spreader/lapper.

25. Method according to claim 14, wherein at least one unidirectional lap of co-blended threads comprising reinforcing filaments and of filaments of an organic material which are intimately mixed is deposited onto the transversely deposited lap, before the heating of the reinforcing-thread/organic-material assembly is carried out.

26. Method according to claim 25, wherein the reinforcing material is glass, and in that the organic material is thermoplastic.

* * * * *